US011896052B2

(12) United States Patent
Batista et al.

(10) Patent No.: US 11,896,052 B2
(45) Date of Patent: Feb. 13, 2024

(54) AEROSOL-GENERATING DEVICE COMPRISING A PLASMONIC HEATING ELEMENT

(71) Applicant: Philip Morris Products S.A., Neuchatel (CH)

(72) Inventors: Rui Nuno Batista, Neuchatel (CH); Chiara Fasciani, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 869 days.

(21) Appl. No.: 16/961,475

(22) PCT Filed: Jan. 11, 2019

(86) PCT No.: PCT/EP2019/050659
§ 371 (c)(1),
(2) Date: Jul. 10, 2020

(87) PCT Pub. No.: WO2019/138055
PCT Pub. Date: Jul. 18, 2019

(65) Prior Publication Data

US 2020/0375253 A1 Dec. 3, 2020

(30) Foreign Application Priority Data

Jan. 12, 2018 (EP) ..... 18151495

(51) Int. Cl.
*A24F 40/46* (2020.01)
*A24F 40/10* (2020.01)
*A24F 40/20* (2020.01)

(52) U.S. Cl.
CPC ..... *A24F 40/46* (2020.01); *A24F 40/10* (2020.01); *A24F 40/20* (2020.01)

(58) Field of Classification Search
CPC ..... A24F 40/10; A24F 40/46; A24F 40/20
See application file for complete search history.

(56) References Cited

U.S. PATENT DOCUMENTS 5,530,225 A 6/1996 Hajaligol
6,766,220 B2 * 7/2004 McRae ..... A61M 11/042 700/282

(Continued)

FOREIGN PATENT DOCUMENTS

CN 101381597 A 3/2009
CN 103416852 A 12/2013

(Continued)

OTHER PUBLICATIONS

Japanese Office Action dated Mar. 6, 2023, in Japanese Patent Application No. 2020-536889 (with English translation), 4 pages.

(Continued)

*Primary Examiner* — Shogo Sasaki
(74) *Attorney, Agent, or Firm* — Oblon, McClelland, Maier & Neustadt, L.L.P.

(57) ABSTRACT

An aerosol-generating device for heating an aerosol-forming substrate is provided, the aerosol-generating device including: a heating element configured to heat the aerosol-forming substrate when the aerosol-forming substrate is received by the aerosol-generating device, the heating element including a plurality of metallic nanoparticles configured to receive light and to generate heat by surface plasmon resonance.

19 Claims, 8 Drawing Sheets

(56) References Cited

U.S. PATENT DOCUMENTS

| | | | | |
|---|---|---|---|---|
| 8,967,155 | B2 | 3/2015 | Bundren et al. | |
| 9,138,017 | B2 | 9/2015 | Garrett et al. | |
| 2010/0051815 | A1 | 3/2010 | Lee | |
| 2011/0265806 | A1* | 11/2011 | Alarcon | A24F 47/00 131/273 |
| 2013/0104916 | A1* | 5/2013 | Bellinger | A61M 11/042 131/328 |
| 2014/0014126 | A1* | 1/2014 | Peleg | A24F 40/57 374/54 |
| 2014/0064324 | A1 | 3/2014 | Kasianowicz et al. | |
| 2014/0182609 | A1* | 7/2014 | Liu | A24F 40/40 131/329 |
| 2014/0230835 | A1* | 8/2014 | Saliman | A24F 40/60 131/329 |
| 2014/0258741 | A1* | 9/2014 | Xiang | G06F 1/24 713/300 |
| 2014/0338686 | A1 | 11/2014 | Plojoux et al. | |
| 2014/0345635 | A1* | 11/2014 | Rabinowitz | A24F 40/50 131/352 |
| 2015/0090277 | A1* | 4/2015 | Xiang | A24F 40/50 131/328 |
| 2015/0173124 | A1* | 6/2015 | Qiu | A24F 40/60 131/328 |
| 2015/0331297 | A1* | 11/2015 | Han | G03H 1/2294 359/254 |
| 2016/0058074 | A1* | 3/2016 | Liu | A24F 40/50 131/329 |
| 2016/0126499 | A1* | 5/2016 | Dai | H10K 50/15 257/40 |
| 2016/0143359 | A1* | 5/2016 | Xiang | A24F 40/53 392/386 |
| 2016/0151493 | A1 | 6/2016 | Pyayt | |
| 2016/0160364 | A1* | 6/2016 | Juluri | C25B 11/051 204/252 |
| 2016/0200179 | A1 | 7/2016 | Kim | |
| 2017/0146263 | A1 | 5/2017 | Kim et al. | |
| 2018/0098577 | A1 | 4/2018 | Frobisher | |
| 2020/0367570 | A1* | 11/2020 | Batista | A24F 40/42 |
| 2020/0375253 | A1* | 12/2020 | Batista | A24F 40/10 |
| 2022/0346448 | A1* | 11/2022 | Nicolas | A24F 40/46 |
| 2023/0019130 | A1* | 1/2023 | Lee | H05B 47/105 |

FOREIGN PATENT DOCUMENTS

| | | | |
|---|---|---|---|
| CN | 104095293 | A | 10/2014 |
| CN | 104470387 | A | 3/2015 |
| CN | 104522892 | A | 4/2015 |
| CN | 104770885 | A | 7/2015 |
| CN | 204426709 | U | 7/2015 |
| CN | 104856235 | A | 8/2015 |
| CN | 204579893 | U | 8/2015 |
| CN | 105774478 | A | 7/2016 |
| CN | 205658376 | U | 10/2016 |
| EA | 022838 | B1 | 3/2016 |
| JP | 2013-254940 | A | 12/2013 |
| JP | 2017-520245 | A | 7/2017 |
| JP | 2017-520878 | A | 7/2017 |
| JP | 2017-537634 | A | 12/2017 |
| KZ | 31524 | B | 9/2016 |
| RU | 2 629 878 | C1 | 9/2017 |
| RU | 2 635 970 | C2 | 11/2017 |
| WO | WO 2014/002881 | A1 | 1/2014 |
| WO | WO 2015/006864 | A1 | 1/2015 |
| WO | WO 2016/112579 | A1 | 7/2016 |
| WO | WO 2016/184783 | A1 | 11/2016 |
| WO | WO 2017/186944 | A1 | 11/2017 |
| WO | WO 2017/207416 | A1 | 12/2017 |

OTHER PUBLICATIONS

Combine Russian Federation Office Action and Search Report dated May 12, 2022, in Russian Federation Patent Application No. 2020124964/03(043250) (with English translation), 17 pages.

Combined Chinese Office Action and Search Report dated Mar. 22, 2023 in Patent Application No. 201980006651.2 (with English language translation), 23 pages.

Alarcon, E. I. et al., "The Biocompatibility and Antibacterial Properties of Collagen-Stabilized, Photochemically Prepared Silver Nanoparticles", Biomaterials 2012, 33, 4947-4956.

Barazzouk, S. et al., "Photoinduced Electron Transfer between Chlorophyll a and Gold Nanoparticles", J. Phys. Chem. B 2005, 109, 716-723.

Baffou, G. et al., "Femtosecond-Pulsed Optical Heating of Gold Nanoparticles", Phys. Rev. B, 2011, 84, 035415, pp. 1-13.

Buffou, G. et al., "Thermo-Plasmonic: Using Metallic Nanostructures as Nanasources of Heat", Laser Photonics Rev. 2013, 7, 2, 171-187.

Baum, T. et al., "Electrochemical Charge Injection into Immobilized Nanosized Gold Particle Ensembles: Potential Modulated Transmission and Reflectance Spectroscopy", Langmuir 1999,15, pp. 866-871.

Chen, S. et al., "Electrochemical Quantized Capacitance Charging of Surface Ensembles of Gold Nanoparticles", J. Phys. Chem. B 1999, 103, pp. 9996-10000.

Chen, S. et al., "Gold Nanoelectrodes of Varied Size: Transition to Molecule-Like Charging", Science 1998, 280, pp. 2098-2101 and cover page.

Coronado, E. A. et al., "Optical Properties of Metallic Nanoparticles: Manipulating Light, Heat and Forces at the Nanoscale", Nanoscale 2011, 3, pp. 4042-4059.

Faraday, M., "Experimental Relations of Gold (and other Metals) to Light", Phil. Trans. R. Soc. 1857, 147, pp. 145-181.

Fasciani, C. et al., "High-Temperature Organic Reactions at Room Temperature Using Plasmon Excitation: Decomposition of Dicumyl Peroxide", Org. Lett. 2011, 13, 204-207.

Feynman, R.P.; "There's Plenty of Room at the Bottom", Journal of microelectromechanical System, 1992, 1, pp. 60-66.

Choi, H. et al., "Know Thy Nano Neighbor. Plasmonic versus Electron Charging Effects of Metal Nanoparticles in Dye-Sensitized Solar Cells", ACS Nano 2012, 6, 4418-4427.

Gomes Silva, C. et al., "Influence of Excitation Wavelength (UV or Visible Light) on the Photocatalytic Activity of Titania Containing Gold Nanopaiticles for the Generation of Hydrogen or Oxygen from Water", J. Am. Chem. Soc. 2011, 133, pp. 595-602.

Sakamoto, M. et al., "Light as a Construction Tool of Metal Nanoparticles: Synthesis and Mechanism", Journal of Photochemistry and Photobiology C: Photochemistry Reviews 2009, 10, 33-56.

Krylova, G. V. et al., "Photochemical Preparation of Nanopanicles of Ag in Aqueous-Alcoholic Solutions and on the Surface of Mesoporous Silica", Exp. Chem. 2005, 41, pp. 105-110.

Huang, H. H. et al., "Photochemical Formation of Silver Nanoparticles in Poly(N-vinylpyrrolidone)", Langmuir 1996, 12, pp. 909-912.

Kamat, P. V. et al., "Electrochemical Modulation of Fluorophore Emission on a Nanostructured Gold Film", Angew. Chem., Int. Ed. 2002, 41, pp. 2764-2767.

Ipe, B. I. et al., "Photoinduced Charge Separation in a Fluorophore-Gold Nanoassembly", J. Phys. Chem. B 2002, 106, pp. 18-21.

Jockusch, S. et al., "Photochemistry and Photophysics of α-Hydroxy Ketones", Macromolecules 2001, 34, pp. 1619-1626.

Shen, X. S. et al., Anisotropic Growth of One-Dimensional Silver Rod-Needle and Plate-Belt Heteronanostructures Induced by Twins and Hcp Phase. J. Am. Chem. Soc. 2009, 131, pp. 10812-10813.

Marin. M. L. et al., "Photochemical Strategies for the Synthesis of Gold Nanopaiticles from Au(III) and Au(I) Using Photoinduced Free Radical Generation", J. Am. Chem. Soc. 2008, 130, pp. 16572-16584.

McGilvray, K. L. et al., "Facile Photochemical Synthesis of Unprotected Aqueous Gold Nanoparticles", J. Am. Chem. Soc. 2006, 128, pp. 15980-15981.

Mie, G. "Contributions XU ~ Optics drier medden , spexially 7 colloidal metallosurcgem", Annals of Physics, Fourth Episode. vol. 25.,Beitrage zur Optik Truber Medien, Speziell Kolloidaler Metallosungen. Annallen der Physik, 1908, 25:, pp. 377-445 (with English Translation).

Mulvaney, P.; "Surface Plasmon Spectroscopy of Nanosized Metal Particles", Langmuir 1996, 12, pp. 788-800.

(56) References Cited

OTHER PUBLICATIONS

Pacioni, N. L. et al., Surface Plasmons Control the Dynamics of Excited Triplet States in the Presence of Gold Nanoparticles J. Am.Chem. Soc. 2010, 132, pp. 6298-6299.
Callegari, A. et al., Photochemically Grown Silver Nanopanicles with Wavelength-Controlled Size and Shape. Nano Lett. 2003, 3, pp. 1565-1568.
Jin, R. C. et al., "Controlling Anisotropic Nanopadicle Growth Through Plasmon Excitation", Nature, 2003, 425, pp. 487-490.
Jin, R. et al., "Photoinduced Conversion of Silver Nanospheres to Nanoprisms", Science, 2001, 294, pp. 1901-1903 and cover page.
Sant'Ana, A. C. et al., "Size-dependent SERS Enhancement of Colloidal Silver Nanoplates: the Case of 2-Amino-5-Nitropyridine", J. Raman Spectrosc. 2009, 40, pp. 183-190.
Scaiano, J. C. et al., "Photochemical Routes to Silver and Gold Nanopanicles", Pure Appl. Chem. 2009, 81, pp. 635-647.
Scaiano, J. C. et al., "Can Surface Plasmon Fields Provide a New Way to Photosensitize Organic Photoreactions? From Designer Nanoparticles to Custom Applications", J. Phys. Chem. Lett. 2013, 4, pp. 1177-1187.
Sciau, P.; "Nanoparticles in Ancient Materials: The Metallic Lustre Decorations of Medieval Ceramics", The Delivery of Nanoparticles, 2012, Cap.25, DOI: 10.5772/34080, 18 pages.
Schmid, G.; "Clusters and Colloids: From Theory to Application", Advanced Materials (Weinheim: VCH), 1994, 1 page.
Stamplecoskie, K. G. et al., "Light Emitting Diode Irradiation Can Control the Morphology and Optical Properties of Silver Nanoparticles", J. Am. Chem. Soc. 2010, 132, pp. 1825-1827.
Underwood, S. et al., "Effect of the Solution Refractive Index on the Color of Gold Colloids", Langmuir 1994, 10, pp. 3427-3430.
Webb, J. A. et al., "Emerging Advances in Nanomedicine with Engineered Gold Nanostructures", Nanoscale DOI: 10.1039/c3nr05112a, 2014, pp. 2502-2530.
Fasciani, C. et al., "Aspartame-stabilized gold-silver bimetallic biocompatible nanostructures with plasmonic photothermal properties, antibacterial activity and long-term stability", J. Am. Chem. Soc., Just Accepted Manuscript DOI: 10.1021/ja510435u, 2014, 7 pages.
McGilvray, K.L. et al., "Photochemical Strategies for the Seed-Mediated Growth of Gold and Gold-Silver Nanoparticles", Langmuir, 28,2012, pp. 16148-16155.
K. G. Stamplecoskie et al., "Dual-Stage Lithography from a Light-Driven, PIasmon-Assisted Process: A Hierarchical Approach to Subwavelength Features", Langumir, 28, 2012, pp. 10957-10961.
C. J. B. Alejo et al., "Reduction of Resazurin to Resorufin Catalyzed by Gold Nanoparticles: Dramatic Reaction Acceleration by Laser or LED Plasmon Excitation", Catal. Sci. Technol.,1, 2011, pp. 1506-1511.
Juan C. Scaiano et al. "Tuning plasmon transition and their applications in organic photochemistry", Pure Appl. Chem., 83, 4, 2011, pp. 913-930.
Stefan A. Maier; "Plasmonics: Fundamentals And Applications", 229 pages https://www.ethz.ch/content/dam/ethz/special-interest/mavt/process-engineering/omel-dam/documents/Texlbook/Maier2007.pdf.
International Search Report and Written Opinion dated Mar. 21, 2019 in PCT/EP2019/050659 filed Jan. 11, 2019.
Cortie et al., "Plasmonic heating of gold nanoparticles and its exploitation", Institute for Nanoscale Technology, University of Technology Sydney, PO Box 123, Broadway NSW 2007, Australia, Proc. of SPIE vol. 5649, XP055093379, pp. 565-573.

* cited by examiner

AEROSOL-GENERATING DEVICE COMPRISING A PLASMONIC HEATING ELEMENT

The present invention relates to an aerosol-generating device comprising a heating element arranged to generate heat by surface plasmon resonance. The present invention also relates to an aerosol-generating system comprising the aerosol-generating device.

A number of electrically-operated aerosol-generating systems in which an aerosol-generating device having an electric heating element is used to heat an aerosol-forming substrate, such as a tobacco plug, have been proposed in the art. One aim of such aerosol-generating systems is to reduce known harmful or potentially harmful smoke constituents of the type produced by the combustion and pyrolytic degradation of tobacco in conventional cigarettes. The aerosol-forming substrate may be provided as part of an aerosol-generating article which is inserted into a chamber or cavity in the aerosol-generating device. In some known systems, to heat the aerosol-forming substrate to a temperature at which it is capable of releasing volatile components that can form an aerosol, a resistive heating element is inserted into or around the aerosol-forming substrate when the article is received in the aerosol-generating device.

Other known electrically operated aerosol-generating systems are configured to heat a liquid aerosol-forming substrate, such as a nicotine-containing liquid. Such systems typically comprise a wick arranged to transport liquid aerosol-forming substrate from a storage portion and a resistive heating element coiled around a portion of the wick.

A number of electrically-operated aerosol-generating systems comprising inductive heating systems have also been proposed.

However, heating systems in known aerosol-generating systems exhibit a number of disadvantages. For example, when using resistive heating elements it may be difficult to achieve homogenous heating of an aerosol-generating substrate. Difficulty achieving accurate temperature control is another disadvantage commonly associated with resistive heating elements. The assembly process for resistive heating elements may also lead to resistive losses in the heating element circuit, for example at soldered connections between a resistive heating track and a power supply circuit.

Inductive heating systems also have their own disadvantages. For example, achieving efficient inductive heating of a susceptor element while minimising a power supply to an inductor coil requires positioning of the inductor coil as close to the susceptor element as possible. This may make it difficult to design an inductively heated aerosol-generating system that is efficient as well as practical to manufacture and use.

Accordingly, it would be desirable to provide an aerosol-generating device comprising a heating arrangement that mitigates or overcomes at least some of these disadvantages with known devices.

According to a first aspect of the present invention there is provided an aerosol-generating device for heating an aerosol-forming substrate. The aerosol-generating device comprises a heating element arranged to heat an aerosol-forming substrate when the aerosol-forming substrate is received by the aerosol-generating device. The heating element comprises a plurality of metallic nanoparticles arranged to receive light from a light source and generate heat by surface plasmon resonance.

As used herein, the term "surface plasmon resonance" refers to a collective resonant oscillation of free electrons of the metallic nanoparticles and thus polarization of charges at the surface of the metallic nanoparticles. The collective resonant oscillation of the free electrons and thus polarisation of charges is stimulated by light incident on the metallic nanoparticles from a light source. Energy from the oscillating free electrons may be dissipated by several mechanisms, including heat. Therefore, when the metallic nanoparticles are irradiated with a light source, the metallic nanoparticles generate heat by surface plasmon resonance.

As used herein, the term "metallic nanoparticles" refers to metallic particles having a maximum diameter of about 1 micrometre or less. Metallic nanoparticles that generate heat by surface plasmon resonance when excited by incident light may also be known as plasmonic nanoparticles.

As used herein, an "aerosol-generating device" relates to a device that may interact with an aerosol-forming substrate to generate an aerosol.

As used herein, the term "aerosol-forming substrate" relates to a substrate capable of releasing volatile compounds that may form an aerosol. Such volatile compounds may be released by heating the aerosol-forming substrate. An aerosol-forming substrate may be part of an aerosol-generating article.

As used herein, the term "aerosol-generating system" refers to a combination of an aerosol-generating device and one or more aerosol-forming substrates or aerosol-forming articles for use with the device. An aerosol-generating system may include additional components, such as a charging unit for recharging an on-board electric power supply in an electrically operated or electric aerosol-generating device.

Advantageously, the heating element of aerosol-generating devices according to the present invention comprises a plurality of metallic nanoparticles arranged to generate heat by surface plasmon resonance. Therefore, it is not necessary to electrically connect the heating element to a power supply. Advantageously, a heating element that is not electrically connected to a power supply may simplify manufacture of the aerosol-generating device. Advantageously, a heating element that is not electrically connected to a power supply may facilitate servicing of the heating element, replacement of the heating element, or both.

Advantageously, a heating element arranged to generate heat by surface plasmon resonance may provide more homogenous heating of an aerosol-forming substrate when compared to resistive and inductive heating systems. For example, the free electrons of the metallic nanoparticles are excited to the same extent regardless of an angle of incidence of incident light.

Advantageously, a heating element arranged to generate heat by surface plasmon resonance may provide more localised heating when compared to resistive and inductive heating systems. Advantageously, localised heating facilitates heating of discrete portions of an aerosol-forming substrate or a plurality of discrete aerosol-forming substrates. Advantageously, localised heating increases the efficiency of the aerosol-generating device by increasing or maximising the transfer of heat generated by the heating element to an aerosol-forming substrate. Advantageously, localised heating may reduce or eliminate undesired heating of other components of the aerosol-generating device.

The heating element may be arranged to receive light from an external light source and generate heat by surface plasmon resonance. An external light source may comprise ambient light. Ambient light may comprise solar radiation. Ambient light may comprise at least one artificial light source external to the aerosol-generating device.

The aerosol-generating device may comprise a light source, wherein the heating element is arranged to receive light from the light source and generate heat by surface plasmon resonance.

Advantageously, providing the aerosol-generating device with a light source may allow the heating element to generate heat without receiving light from an external light source. Advantageously, providing the aerosol-generating device with a light source may provide improved control of the illumination of the heating element. Advantageously, controlling the illumination of the heating element controls the temperature to which the heating element is heated by surface plasmon resonance.

The light source may be configured to emit at least one of ultraviolet light, infrared light and visible light. Preferably, the light source is configured to emit visible light. Advantageously, a light source configured to emit visible light may be inexpensive, convenient to use, or both.

Preferably, the light source is configured to emit light comprising at least one wavelength between 380 nanometres and 700 nanometres.

Preferably, the light source is configured for a peak emission wavelength of between about 495 nanometres and about 580 nanometres. As used herein, "peak emission wavelength" refers to the wavelength at which a light source exhibits maximum intensity. Advantageously, a peak emission wavelength of between about 495 nanometres and about 580 nanometres may provide maximum heating of the heating element by surface plasmon resonance, particularly when the plurality of metallic nanoparticles comprises at least one of gold, silver, platinum, and copper.

The light source may comprise at least one of a light emitting diode and a laser. Advantageously, light emitting diodes and lasers may have a compact size suited to use in an aerosol-generating device. In embodiments in which the light source comprises at least one laser, the at least one laser may comprise at least one of a solid state laser and a semiconductor laser.

The light source may comprise a plurality of light sources. The light sources may be the same type of light source. At least some of the light sources may be different types of light source. The plurality of light sources may comprise any combination of the types of light source described herein.

Advantageously, a plurality of light sources may facilitate customisation of a heating profile generated by the aerosol-generating device during use.

At least one of the light sources may be a primary light source and at least one of the light sources may be a backup light source. The aerosol-generating device may be configured to emit light from one or more backup light sources only when one or more of the primary light sources is inoperative.

At least one of the light sources may be arranged to irradiate only a portion of the plurality of metallic nanoparticles. Each of the plurality of light sources may be arranged to irradiate a different portion of the plurality of metallic nanoparticles.

The aerosol-generating device may be configured so that the plurality of light sources irradiate different portions of the plurality of metallic nanoparticles at the same time. Advantageously, irradiating different portions of the plurality of metallic nanoparticles at the same time may facilitate homogenous heating of the heating element. Advantageously, irradiating different portions of the plurality of metallic nanoparticles at the same time may facilitate simultaneous heating of a plurality of discrete aerosol-forming substrates.

The aerosol-generating device may be configured so that the plurality of light sources irradiate different portions of the plurality of metallic nanoparticles at different times. Advantageously, irradiating different portions of the plurality of metallic nanoparticles at different times may facilitate heating of different portions of an aerosol-forming substrate at different times. Advantageously, irradiating different portions of the plurality of metallic nanoparticles at different times may facilitate heating of a plurality of discrete aerosol-forming substrates at different times.

Preferably, the aerosol-generating device comprises an electrical power supply and a controller configured to supply electrical power from the electrical power supply to the light source.

In embodiments in which the aerosol-generating device comprises a plurality of light sources, the electrical power supply may comprise a single source of electrical power arranged to supply electrical power to the plurality of light sources.

In embodiments in which the aerosol-generating device comprises a plurality of light sources, the electrical power supply may comprise a plurality of sources of electrical power arranged to supply electrical power to the plurality of light sources.

In embodiments in which the aerosol-generating device comprises a plurality of light sources, the controller may be configured to selectively supply electrical power to at least some of the plurality of light sources. The controller may be configured to selectively vary a supply of electrical power to at least some of the plurality of light sources.

In embodiments in which the plurality of light sources are configured to irradiate different portions of the plurality of metallic nanoparticles to heat a plurality of discrete aerosol-forming substrates, the controller may selectively supply electrical power to at least some of the plurality of light sources to selectively heat at least some of the plurality of discrete aerosol-forming substrates. The controller may selectively vary a supply of electrical power to at least some of the plurality of light sources to vary a ratio of heating of at least some of the plurality of discrete aerosol-forming substrates.

Advantageously, by varying the relative heating of at least some of a plurality of discrete aerosol-forming substrates, the aerosol-generating device may vary the composition of an aerosol delivered to a user.

Preferably, the aerosol-generating device comprises a user input device. The user input device may comprise at least one of a push-button, a scroll-wheel, a touch-button, a touch-screen, and a microphone. Advantageously, the user input device allows a user to control one or more aspects of the operation of the aerosol-generating device. In embodiments in which the aerosol-generating device comprises a light source, a controller and an electrical power supply, the user input device may allow a user to activate a supply of electrical power to the light source, to deactivate a supply of electrical power to the light source, or both.

In embodiments in which the controller is configured to selectively supply electrical power to at least some of a plurality of light sources, preferably the controller is configured to selectively supply electrical power to at least some of the plurality of light sources in response to a user input received by the user input device.

In embodiments in which the controller is configured to selectively vary a supply of electrical power to at least some of a plurality of light sources, preferably the controller is configured to selectively vary a supply of electrical power to at least some of the plurality of light sources in response to a user input received by the user input device.

The electrical power supply may comprise a DC power supply. The electrical power supply may comprise at least one battery. The at least one battery may include a rechargeable lithium ion battery. The electrical power supply may comprise another form of charge storage device such as a capacitor. The electrical power supply may require recharging. The electrical power supply may have a capacity that allows for the storage of enough energy for one or more uses of the aerosol-generating device. For example, the electrical power supply may have sufficient capacity to allow for the continuous generation of aerosol for a period of around six minutes, corresponding to the typical time taken to smoke a conventional cigarette, or for a period that is a multiple of six minutes. In another example, the electrical power supply may have sufficient capacity to allow for a predetermined number of puffs or discrete activations.

The controller may be configured to commence a supply of electrical power from the electrical power supply to the light source at the start of a heating cycle. The controller may be configured to terminate a supply of electrical power from the electrical power supply to the light source at the end of a heating cycle.

The controller may be configured to provide a continuous supply of electrical power from the electrical power supply to the light source.

The controller may be configured to provide an intermittent supply of electrical power from the electrical power supply to the light source. The controller may be configured to provide a pulsed supply of electrical power from the electrical power supply to the light source.

Advantageously, a pulsed supply of electrical power to the light source may facilitate control of the total output from the light source during a time period. Advantageously, controlling a total output from the light source during a time period may facilitate control of a temperature to which the heating element is heated by surface plasmon resonance.

Advantageously, a pulsed supply of electrical power to the light source may increase thermal relaxation of free electrons excited by surface plasmon resonance compared to other relaxation processes, such as oxidative and reductive relaxation. Therefore, advantageously, a pulsed supply of electrical power to the light source may increase heating of the heating element. Preferably, the controller is configured to provide a pulsed supply of electrical power from the electrical power supply to the light source so that the time between consecutive pulses of light from the light source is equal to or less than about 1 picosecond. In other words, the time between the end of each pulse of light from the light source and the start of the next pulse of light from the light source is equal to or less than about 1 picosecond.

The controller may be configured to vary the supply of electrical power from the electrical power supply to the light source. In embodiments in which the controller is configured to provide a pulsed supply of electrical power to the light source, the controller may be configured to vary a duty cycle of the pulsed supply of electrical power. The controller may be configured to vary at least one of a pulse width and a period of the duty cycle.

The aerosol-generating device may comprise a temperature sensor. The temperature sensor may be arranged to sense a temperature of at least one of the heating element and an aerosol-forming substrate during use of the aerosol-generating device. The aerosol-generating device may be configured to vary a supply of electrical power to the light source in response to a change in temperature sensed by the temperature sensor. In embodiments in which the aerosol-generating device comprises an electrical power supply and a controller, preferably the controller is configured to vary the supply of electrical power from the electrical power supply to the light source in response to a change in temperature sensed by the temperature sensor.

The aerosol-generating device may comprise one or more optical elements to facilitate the transmission of light from a light source to the heating element. The one or more optical elements may include at least one of an aperture, a window, a lens, a reflector, and an optical fibre.

Advantageously, at least one of an aperture and a window may facilitate the transmission of light from an external light source to the heating element. The aerosol-generating device may comprise a housing, wherein at least one of an aperture and a window is positioned on the housing.

Advantageously, at least one of a lens, a reflector and an optical fibre may concentrate or focus light emitted from a light source onto the heating element. Advantageously, concentrating or focusing light onto the heating element may increase the temperature to which the heating element is heated by surface plasmon resonance.

The plurality of metallic nanoparticles may comprises at least one of gold, silver, platinum, copper, palladium, aluminium, chromium, titanium, rhodium, and ruthenium. The plurality of metallic nanoparticles may comprise at least one metal in elemental form. The plurality of metallic nanoparticles may comprise at least one metal in a metallic compound. The metallic compound may comprise at least one metal nitride.

Preferably, the plurality of metallic nanoparticles comprises at least one of gold, silver, platinum, and copper. Advantageously, gold, silver, platinum, and copper nanoparticles may exhibit strong surface plasmon resonance when irradiated with visible light.

The plurality of metallic nanoparticles may comprise a single metal. The plurality of metallic nanoparticles may comprise a mixture of different metals.

The plurality of metallic nanoparticles may comprise a plurality of first nanoparticles comprising a first metal and a plurality of second nanoparticles comprising a second metal.

At least some of the plurality of metallic nanoparticles may each comprise a mixture of two or more metals. At least some of the plurality of metallic nanoparticles may comprise a metal alloy. At least some of the plurality of metallic nanoparticles may each comprise a core-shell configuration, wherein the core comprises a first metal and the shell comprises a second metal.

In embodiments in which the aerosol-generating device comprises a light source, preferably the plurality of metallic nanoparticles comprises a number average maximum diameter that is less than or equal to the peak emission wavelength of the light source.

The plurality of metallic nanoparticles may comprise a number average maximum diameter of less than about 700 nanometres, preferably less than about 600 nanometres, preferably less than about 500 nanometres, preferably less than about 400 nanometres, preferably less than about 300 nanometres, preferably less than about 200 nanometres, preferably less than about 150 nanometres, preferably less than about 100 nanometres.

The heating element may be formed from the plurality of metallic nanoparticles.

The heating element may comprise a substrate layer and a coating layer positioned on at least a portion of the substrate layer, wherein the coating layer comprises the plurality of metallic nanoparticles. Advantageously, the substrate layer may be formed from a material selected for desired mechanical properties. Advantageously, the coating layer may be formed to optimise the surface plasmon resonance of the plurality of metallic nanoparticles when the coating layer is exposed to light from a light source.

The substrate layer may be formed from any suitable material. The substrate layer may comprise a metal. The substrate layer may comprise a polymeric material. The substrate layer may comprise a ceramic.

The substrate layer may be electrically conductive. The substrate layer may be electrically insulating.

The coating layer may be provided on the substrate layer using any suitable process. The coating layer may be formed by depositing the plurality of metallic nanoparticles on the substrate layer using a physical vapour deposition process.

The coating layer may be a substantially continuous layer.

The coating layer may comprise a plurality of discrete areas of metallic nanoparticles, wherein the plurality of discrete areas are spaced apart from each other on the substrate layer. Advantageously, a plurality of discrete areas of metallic nanoparticles may facilitate heating of a plurality of discrete portions of an aerosol-forming substrate. Advantageously, a plurality of discrete areas of metallic nanoparticles may facilitate heating of a plurality of discrete aerosol-forming substrates.

The aerosol-generating device may comprise a light source arranged to irradiate a plurality of the discrete areas of metallic nanoparticles. The aerosol-generating device may comprise a plurality of light sources arranged to irradiate the plurality of discrete areas of metallic nanoparticles. Each of the plurality of light sources may be arranged to irradiate only one of the discrete areas of metallic nanoparticles.

The heating element may comprise an electrically resistive portion arranged to receive a supply of electrical power. During use, a supply of electrical power to the electrically resistive portion may resistively heat the electrically resistive portion. Advantageously, the electrically resistive portion may provide a source of heat in addition to heat generated by surface plasmon resonance of the plurality of metallic nanoparticles.

The plurality of metallic nanoparticles may form the electrically resistive portion.

In embodiments in which the heating element comprises a substrate layer and a coating layer, at least one of the substrate layer and the coating layer may form the electrically resistive portion. The substrate layer may comprise an electrically resistive material. The electrically resistive material may comprise at least one of an electrically resistive metal and an electrically resistive ceramic. The substrate layer may be formed from the electrically resistive material. The substrate layer may comprise a woven material, wherein a plurality of threads of the electrically resistive material form at least part of the woven material.

In embodiments in which the aerosol-generating device comprises an electrical power supply and a controller, preferably the controller is arranged to provide a supply of electrical power from the electrical power supply to the electrically resistive portion.

The aerosol-generating device may be arranged to generate heat using the electrically resistive portion in addition to generating heat by surface plasmon resonance of the plurality of metallic nanoparticles. The aerosol-generating device may be arranged to generate heat using the electrically resistive portion as an alternative to generating heat by surface plasmon resonance of the plurality of metallic nanoparticles.

The aerosol-generating device may be arranged to generate heat using the electrically resistive portion as a backup to generating heat by surface plasmon resonance of the plurality of metallic nanoparticles. For example, the aerosol-generating device may be arranged to generate heat using the electrically resistive portion in the event that heating of the plurality of metallic nanoparticles by surface plasmon resonance is insufficient.

The aerosol-generating device may be arranged to generate heat using the electrically resistive portion at the start of a heating cycle. In other words, the electrically resistive portion may be used to generate heat to raise the temperature of the heating element to an initial operating temperature. The aerosol-generating device may be arranged to reduce or terminate a supply of electrical power to the electrically resistive portion when the temperature of the heating element reaches an initial operating temperature.

The heating element may comprise a first surface arranged to receive light from a light source and generate heat by surface plasmon resonance of the plurality of metallic nanoparticles. The first surface may comprise a plurality of surface features defining a three-dimensional shape. The first surface may comprise at least one of a plurality of protrusions and a plurality of depressions. The first surface may have an undulating shape.

Advantageously, a first surface comprising a plurality of surface features may increase the surface area of the first surface. Advantageously, increasing the surface area of the first surface may increase heating of the plurality of metallic nanoparticles by surface plasmon resonance when light is incident on the first surface.

In embodiments in which the heating element comprises a substrate layer and a coating layer, a first surface of the substrate layer may define the plurality of surface features, wherein the coating layer is provided on the first surface of the substrate layer to form the first surface of the heating element.

The heating element may comprise a second surface arranged to transfer heat to an aerosol-forming substrate during use. The second surface may be on an opposite side of the heating element to the first surface. In embodiments in which the heating element comprises a substrate layer and a coating layer, preferably the substrate layer comprises a first surface on which the coating layer is provided to form the first surface of the heating element, and a second surface forming the second surface of the heating element. Preferably, the substrate layer comprises a thermally conductive material to facilitate the transfer of heat from the coating layer to the second surface of the heating element.

At least a portion of the heating element may be porous. Advantageously, a porous portion of the heating element may allow airflow through the heating element.

At least a portion of the heating element may be formed from a porous material. At least a portion of the heating element may be formed from a woven material, wherein a plurality of pores are formed between threads of the woven material.

At least a portion of the heating element may be provided with a porosity. For example, a plurality of pores may be formed in at least a portion of the heating element. A plurality of pores may be formed using any suitable process. A plurality of pores may be formed using at least one of laser perforation and electron discharge machining.

In embodiments in which the heating element comprises a substrate layer and a coating layer, preferably at least a portion of the substrate layer is porous.

The aerosol-generating device may comprise a cavity for receiving at least part of an aerosol-forming substrate. The cavity may be suitable for receiving at least part of an aerosol-generating article comprising an aerosol-forming substrate.

The aerosol-generating device may comprise a housing, wherein the housing at least partially defines the cavity.

At least part of the heating element may be positioned within the cavity. At least part of the heating element may extend into the cavity.

The heating element may at least partially define the cavity so that, when an aerosol-forming substrate is received within the cavity, at least part of the aerosol-forming substrate is received adjacent the heating element.

Advantageously, positioning at least part of the heating element within the cavity or defining at least part of the cavity with the heating element may facilitate the transfer of heat from the heating element to an aerosol-forming substrate during use of the aerosol-generating device.

The aerosol-generating device may comprise a device connector for connecting to a corresponding article connector on an aerosol-generating article comprising an aerosol-forming substrate. The device connector may include at least one of a screw connector, a bayonet connector and a snap connector.

Preferably, the device connector comprises a liquid transfer passage arranged to receive a liquid aerosol-forming substrate from an aerosol-generating article connected to the device connector. The aerosol-generating device may comprise a liquid transport element in fluid communication with the liquid transfer passage and arranged to transport liquid aerosol-forming substrate from the liquid transfer passage and towards the heating element. At least a portion of the liquid transfer element may be disposed within the liquid transfer passage. The liquid transport element may comprise a capillary wick.

The aerosol-generating device may comprise a storage portion and an aerosol-forming substrate disposed within the storage portion. Advantageously, providing an aerosol-forming substrate as part of the aerosol-generating device may be suited to providing a compact aerosol-generating device. Advantageously, providing an aerosol-forming substrate as part of the aerosol-generating device may simplify use of the aerosol-generating device by eliminating the need for a user to carry a separate aerosol-generating article.

Preferably, the aerosol-forming substrate is at least one of replaceable and refillable.

The aerosol-forming substrate may comprise a solid aerosol-forming substrate. The solid aerosol-forming substrate may comprise tobacco. The solid aerosol-forming substrate may comprise a tobacco-containing material containing volatile tobacco flavour compounds which are released from the substrate upon heating.

The solid aerosol-forming substrate may comprise a non-tobacco material. The solid aerosol-forming substrate may comprise tobacco-containing material and non-tobacco containing material.

The solid aerosol-forming substrate may include at least one aerosol-former. As used herein, the term 'aerosol former' is used to describe any suitable known compound or mixture of compounds that, in use, facilitates formation of an aerosol. Suitable aerosol-formers include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferred aerosol formers are polyhydric alcohols or mixtures thereof, such as propylene glycol, triethylene glycol, 1,3-butanediol and, most preferred, glycerine.

The solid aerosol-forming substrate may comprise a single aerosol former. Alternatively, the solid aerosol-forming substrate may comprise a combination of two or more aerosol formers.

The solid aerosol-forming substrate may have an aerosol former content of greater than 5 percent on a dry weight basis.

The solid aerosol-forming substrate may have an aerosol former content of between approximately 5 percent and approximately 30 percent on a dry weight basis.

The solid aerosol-forming substrate may have an aerosol former content of approximately 20 percent on a dry weight basis.

The aerosol-forming substrate may comprise a liquid aerosol-forming substrate. The aerosol-generating device may comprise a liquid transport element arranged to transport the liquid aerosol-forming substrate from the storage portion and towards the heating element. The liquid transport element may comprise a capillary wick.

The liquid aerosol-forming substrate may comprise water.

The liquid aerosol-forming substrate may comprise an aerosol-former. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine or polyethylene glycol.

The liquid aerosol-forming substrate may comprise at least one of nicotine or a tobacco product. Additionally, or alternatively, the liquid aerosol-forming substrate may comprise another target compound for delivery to a user. In embodiments in which the liquid aerosol-forming substrate comprises nicotine, the nicotine may be included in the liquid aerosol-forming substrate with an aerosol-former.

The aerosol-generating device may comprise a first aerosol-forming substrate and a second aerosol-forming substrate. Preferably, the heating element is arranged to heat both the first aerosol-forming substrate and the second aerosol-forming substrate.

The first aerosol-forming substrate may comprise a nicotine source and the second aerosol-forming substrate may comprise an acid source. During use, the heating element may heat the nicotine source and the acid source to generate a nicotine-containing vapour and an acid vapour. The nicotine vapour and the acid vapour react with each other in the gas phase to generate an aerosol comprising nicotine salt particles.

The nicotine source may comprise nicotine, nicotine base or a nicotine salt.

The nicotine source may comprise a first carrier material impregnated with between about 1 milligram and about 50 milligrams of nicotine. The nicotine source may comprise a first carrier material impregnated with between about 1 milligram and about 40 milligrams of nicotine. Preferably, the nicotine source comprises a first carrier material impregnated with between about 3 milligrams and about 30 milligrams of nicotine. More preferably, the nicotine source comprises a first carrier material impregnated with between about 6 milligrams and about 20 milligrams of nicotine. Most preferably, the nicotine source comprises a first carrier material impregnated with between about 8 milligrams and about 18 milligrams of nicotine.

In embodiments in which the first carrier material is impregnated with nicotine base or a nicotine salt, the amounts of nicotine recited herein are the amount of nicotine base or amount of ionised nicotine, respectively.

The first carrier material may be impregnated with liquid nicotine or a solution of nicotine in an aqueous or non-aqueous solvent.

The first carrier material may be impregnated with natural nicotine or synthetic nicotine.

The acid source may comprise an organic acid or an inorganic acid.

Preferably, the acid source comprises an organic acid, more preferably a carboxylic acid, most preferably an alpha-keto or 2-oxo acid or lactic acid.

Preferably, the acid source comprises an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid, lactic acid and combinations thereof. Preferably, the acid source comprises pyruvic acid or lactic acid. More preferably, the acid source comprises lactic acid.

Preferably, the acid source comprises a second carrier material impregnated with acid.

The first carrier material and the second carrier material may be the same or different.

Preferably, the first carrier material and the second carrier material have a density of between about 0.1 grams/cubic centimetre and about 0.3 grams/cubic centimetre.

Preferably, the first carrier material and the second carrier material have a porosity of between about 15 percent and about 55 percent.

The first carrier material and the second carrier material may comprise one or more of glass, cellulose, ceramic, stainless steel, aluminium, polyethylene (PE), polypropylene, polyethylene terephthalate (PET), poly(cyclohexanedimethylene terephthalate) (PCT), polybutylene terephthalate (PBT), polytetrafluoroethylene (PTFE), expanded polytetrafluoroethylene (ePTFE), and BAREX®.

The first carrier material acts as a reservoir for the nicotine. Preferably, the first carrier material is chemically inert with respect to nicotine.

The second carrier material acts as a reservoir for the acid. Preferably, the second carrier material is chemically inert with respect to the acid.

Preferably, the acid source is a lactic acid source comprising a second carrier material impregnated with between about 2 milligrams and about 60 milligrams of lactic acid.

Preferably, the lactic acid source comprises a second carrier material impregnated with between about 5 milligrams and about 50 milligrams of lactic acid. More preferably, the lactic acid source comprises a second carrier material impregnated with between about 8 milligrams and about 40 milligrams of lactic acid. Most preferably, the lactic acid source comprises a second carrier material impregnated with between about 10 milligrams and about 30 milligrams of lactic acid.

Preferably, the aerosol-generating device comprises an airflow inlet and an airflow outlet in fluid communication with the airflow inlet. Preferably, the aerosol-generating device comprises at least one airflow passage providing fluid communication between the airflow inlet and the airflow outlet. Preferably, the aerosol-generating device is arranged so that, during use, an aerosol generated by heating an aerosol-forming substrate with the heating element is received within the at least one airflow passage. Preferably, at least a portion of the heating element is disposed within the at least one airflow passage. In embodiments in which the aerosol-generating device comprises a cavity for receiving at least part of an aerosol-forming substrate, the cavity may form at least part of the at least one airflow passage.

The aerosol-generating device may comprise an airflow sensor arranged to sense airflow through the aerosol-generating device. During use, airflow through the device may be indicative of a user drawing on the aerosol-generating device. In embodiments in which the aerosol-generating device comprises at least one light source, the aerosol-generating device may be arranged to supply electrical power to the at least one light source when the airflow sensor senses airflow through the aerosol-generating device. Advantageously, supplying electrical power to at least one light source when the airflow sensor senses airflow through the device may heat the heating element only when a user is drawing on the aerosol-generating device. Advantageously, heating the heating element only when a user is drawing on the aerosol-generating device may generate aerosol from an aerosol-forming substrate only when needed.

According to a second aspect of the present invention there is provided an aerosol-generating system comprising an aerosol-generating device according to the first aspect of the present invention, in accordance with any of the embodiments described herein. The aerosol-generating system also comprises an aerosol-generating article comprising an aerosol-forming substrate, wherein the aerosol-generating device is configured to receive at least a portion of the aerosol-generating article.

The aerosol-generating article may comprise any of the aerosol-forming substrates described herein with respect to the first aspect of the present invention.

In embodiments in which the aerosol-generating device comprises a cavity, preferably the cavity is arranged to receive at least a portion of the aerosol-generating article.

In embodiments in which the aerosol-generating device comprises a device connector, preferably the aerosol-generating article comprises an article connector configured to connect to the device connector. The article connector may comprise at least one of a screw connector, a bayonet connector, and a snap connector.

The aerosol-generating article may comprise an article housing, wherein the aerosol-forming substrate is disposed within the article housing. An aerosol-generating article comprising an article housing may also be referred to as a cartridge.

Preferably, the article housing defines an article air inlet and an article air outlet, wherein the aerosol-forming substrate is in fluid communication with the article air inlet and the article air outlet.

The article housing may define a heater cavity, wherein at least a portion of the heating element is received within the heater cavity when the aerosol-generating device receives the aerosol-generating article.

The aerosol-generating article may comprise a wrapper wrapped around at least a portion of the aerosol-forming substrate. Aerosol-generating articles comprising a wrapper may be particularly suited to embodiments in which the aerosol-forming substrate comprises a solid aerosol-forming substrate. The wrapper may be a paper wrapper.

The aerosol-generating article may have a total length of between approximately 30 millimetres and approximately 100 millimetres. The aerosol-generating article may have an external diameter of between approximately 5 millimetres and approximately 13 millimetres.

The aerosol-generating article may comprise a mouthpiece positioned downstream of the aerosol-forming substrate. The mouthpiece may be located at a downstream end of the aerosol-generating article. The mouthpiece may be a cellulose acetate filter plug. Preferably, the mouthpiece is approximately 7 millimetres in length, but can have a length of between approximately 5 millimetres to approximately 10 millimetres.

The aerosol-generating article may have a diameter of between approximately 5 millimetres and approximately 12 millimetres.

In a preferred embodiment, the aerosol-generating article has a total length of between approximately 40 millimetres and approximately 50 millimetres. Preferably, the aerosol-generating article has a total length of approximately 45 millimetres. Preferably, the aerosol-generating article has an external diameter of approximately 7.2 millimetres.

The invention will now be further described, by way of example only, with reference to the accompanying drawings in which.

Figure 1:
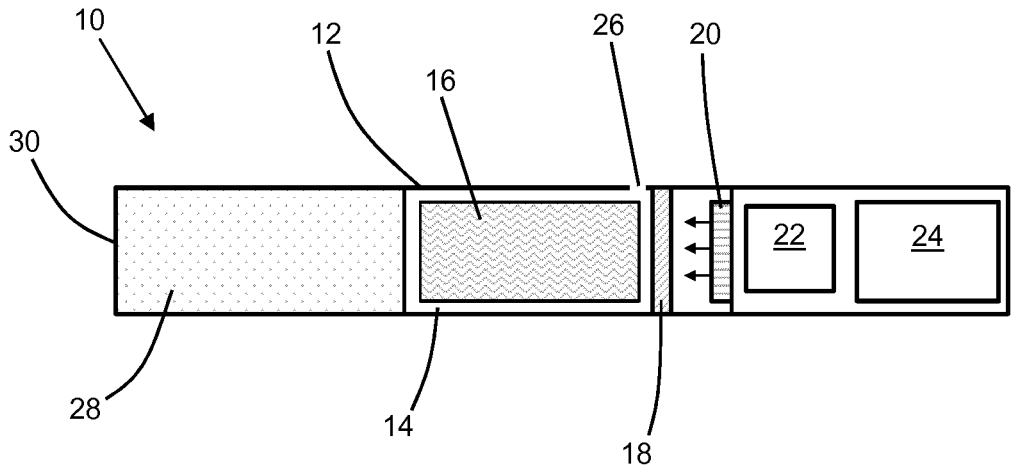
FIG. 1 shows a cross-sectional view of an aerosol-generating device according to a first embodiment of the present invention.

FIG. 1 shows a cross-sectional view of an aerosol-generating device 10 according to a first embodiment of the present invention. The aerosol-generating device 10 comprises a housing 12 defining a device cavity 14 for receiving an aerosol-forming substrate 16 comprising a tobacco plug. The aerosol-forming substrate 16 may form part of the aerosol-generating device 10 and the aerosol-generating device 10 may be disposable after the aerosol-forming substrate 16 has been consumed. Alternatively, at least two portions of the housing 12 may be separable from each other to allow access to the device cavity 14 for replacement of the aerosol-forming substrate 16.

The aerosol-generating device 10 also comprises a heating element 18 extending across an end of the device cavity 14, the heating element 18 comprising a plurality of metallic nanoparticles. A light source 20 comprising a light emitting diode is disposed within the housing 12 and arranged to irradiate the heating element 18. A controller 22 and a power supply 24 comprising a battery are also disposed within the housing 12. The controller 22 is configured to control a supply of electrical power from the power supply 24 to the light source 20.

The aerosol-generating device 10 also includes an airflow inlet 26 defined by the housing 12 at an upstream end of the device cavity 14, and a filter 28 in fluid communication with a downstream end of the device cavity 14. A downstream end of the filter 28 forms an airflow outlet 30.

During use, the controller 22 supplies electrical power from the power supply 24 to the light source 20 to irradiate the heating element 18. The irradiation of the heating element 18 results in heating of the heating element 18 by surface plasmon resonance of the metallic nanoparticles. Heat from the heating element 18 heats the aerosol-forming substrate 16 to generate an aerosol. When a user draws on the filter 28, airflow enters the device cavity 14 through the airflow inlet 26. Aerosol generated by heating the aerosol-forming substrate 16 is entrained within the airflow through the device cavity 14. The airflow containing the generated aerosol flows out of the device cavity 14 through the filter 28 and the airflow outlet 30 where it is inhaled by the user.

Figure 2:
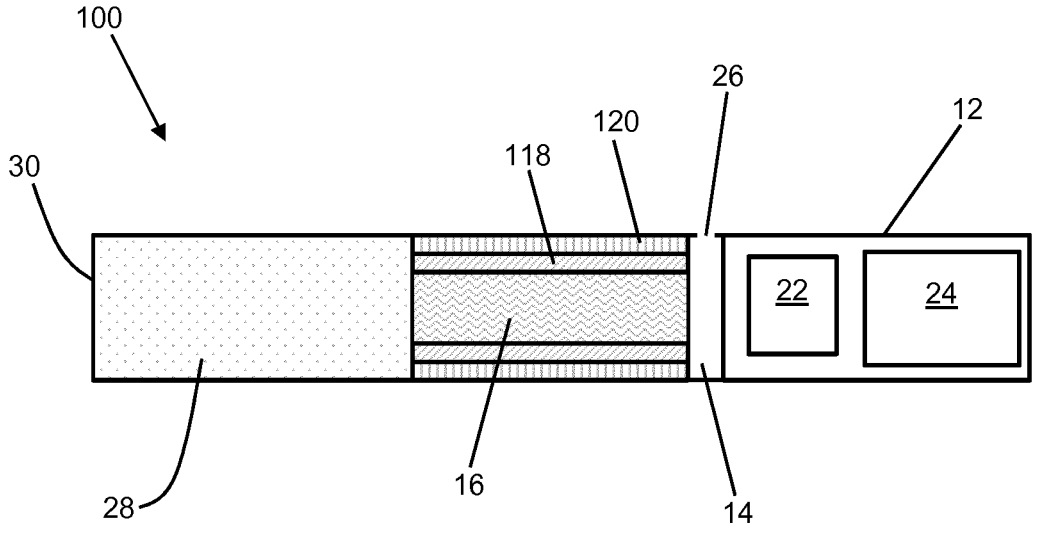
FIG. 2 shows a cross-sectional view of an aerosol-generating device according to a second embodiment of the present invention.

FIG. 2 shows a cross-sectional view of an aerosol-generating device 100 according to a second embodiment of the present invention. The aerosol-generating device 100 is similar to the aerosol-generating device 10 shown in FIG. 1, and like reference numerals are used to designate like parts.

The aerosol-generating device 100 comprises an annular light source 120 disposed within the device cavity 14 and extending around an annular heating element 118 comprising a plurality of metallic nanoparticles. The aerosol-forming substrate 16 comprising a tobacco plug is received within the annular heating element 118.

During use, the controller 22 supplies electrical power from the power supply 24 to the annular light source 120 to irradiate the annular heating element 118. The irradiation of the annular heating element 118 results in heating of the annular heating element 118 by surface plasmon resonance of the metallic nanoparticles. Heat from the annular heating element 118 heats the aerosol-forming substrate 16 to generate an aerosol. When a user draws on the filter 28, airflow enters the device cavity 14 through the airflow inlet 26 and flows through the aerosol-forming substrate 16. Aerosol generated by heating the aerosol-forming substrate 16 is entrained within the airflow through the aerosol-forming substrate 16. The airflow containing the generated aerosol flows out of the aerosol-forming substrate 16 through the filter 28 and the airflow outlet 30 where it is inhaled by the user.

Figure 3:
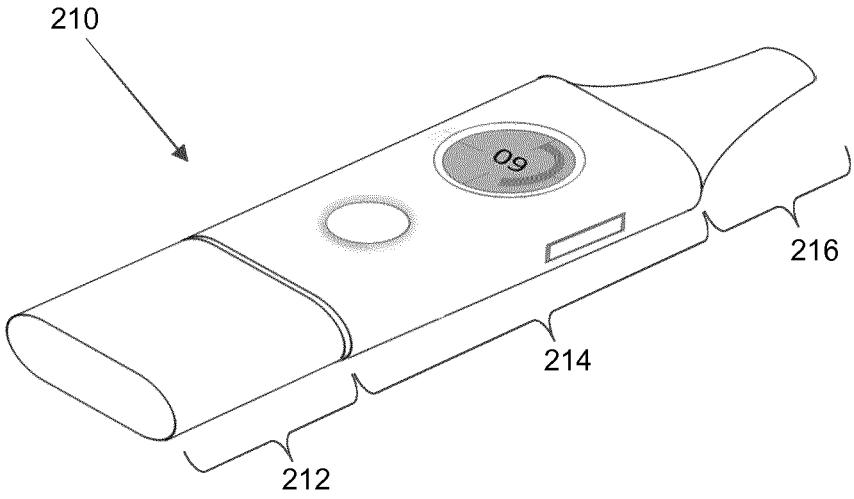
FIGS. 3 and 4 show a perspective view of an aerosol-generating device according to a third embodiment of the present invention.
Figure 4:
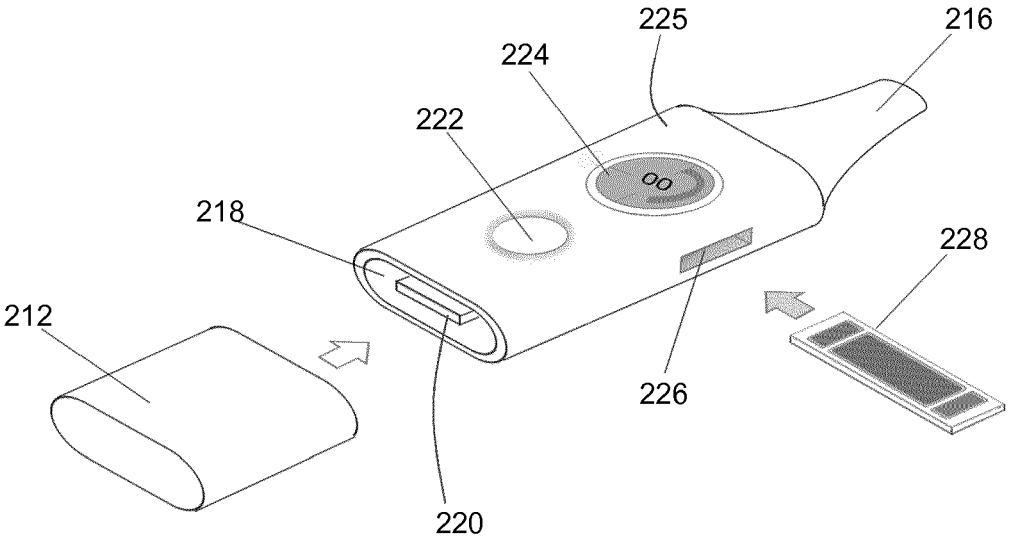

FIGS. 3 and 4 show a perspective view of an aerosol-generating device 210 according to a third embodiment of the present invention. The aerosol-generating device 210 comprises a power supply section 212, an aerosol-generating section 214 and a mouthpiece 216.

The power supply section 212 comprises a power supply for supplying electrical power to components of the aerosol-generating section 214. The aerosol-generating section 214 comprises a connector 218 for receiving the power supply section 212, the connector 218 including an electrical connector 220 for transferring electrical power from the power supply section 212 to the aerosol-generating section 214.

The aerosol-generating section 214 comprises a push-button 222 to allow a user to switch the aerosol-generating device 210 on and off, and an electronic display 224 for providing visual feedback to a user. The aerosol-generating device 210 also comprises a housing 225 defining a device cavity 226 in the aerosol-generating section 214, the device cavity 226 for receiving an aerosol-generating article 228. During use, an aerosol-generating article 228 is received within the device cavity 226 so that the aerosol-generating device 210 and the aerosol-generating article 228 together form an aerosol-generating system.

Figure 5:
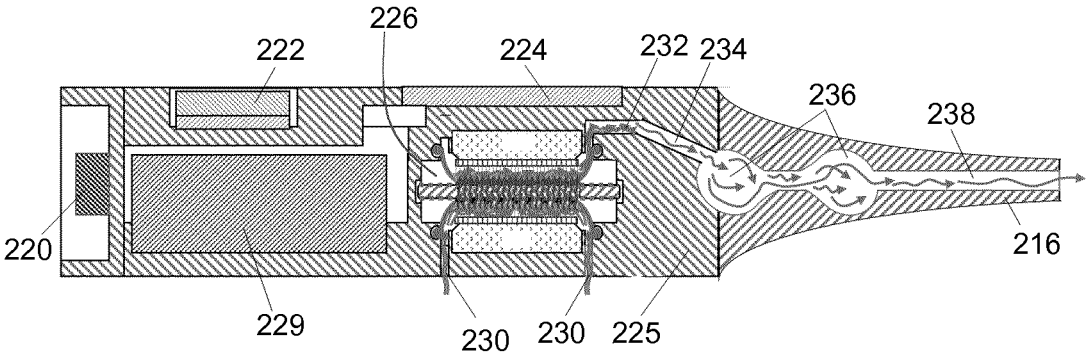
FIG. 5 shows a cross-sectional view of the aerosol-generating section and the mouthpiece of the aerosol-generating device of FIGS. 3 and 4.

FIG. 5 shows a cross-sectional view of the aerosol-generating section 214 and the mouthpiece 216. The aerosol-generating section 214 further comprises a controller 229 arranged to supply electrical power from the power supply section 212 to components within the aerosol-generating section 214. The aerosol-generating section 214 also includes two airflow inlets 230 and an airflow outlet 232 in fluid communication with each other via the device cavity 226. During use, aerosol generated within the device cavity 226 is entrained within airflow through the device cavity 226 and exits the device cavity 226 through the airflow outlet 232. An airflow passage 234 in the aerosol-generating section 214 transfers airflow from the airflow outlet 232 to mixing chambers 236 within the mouthpiece 216. Airflow from the mixing chambers 236 exits the mouthpiece 216 via a mouthpiece outlet 238 for delivery to a user.

Figure 6:
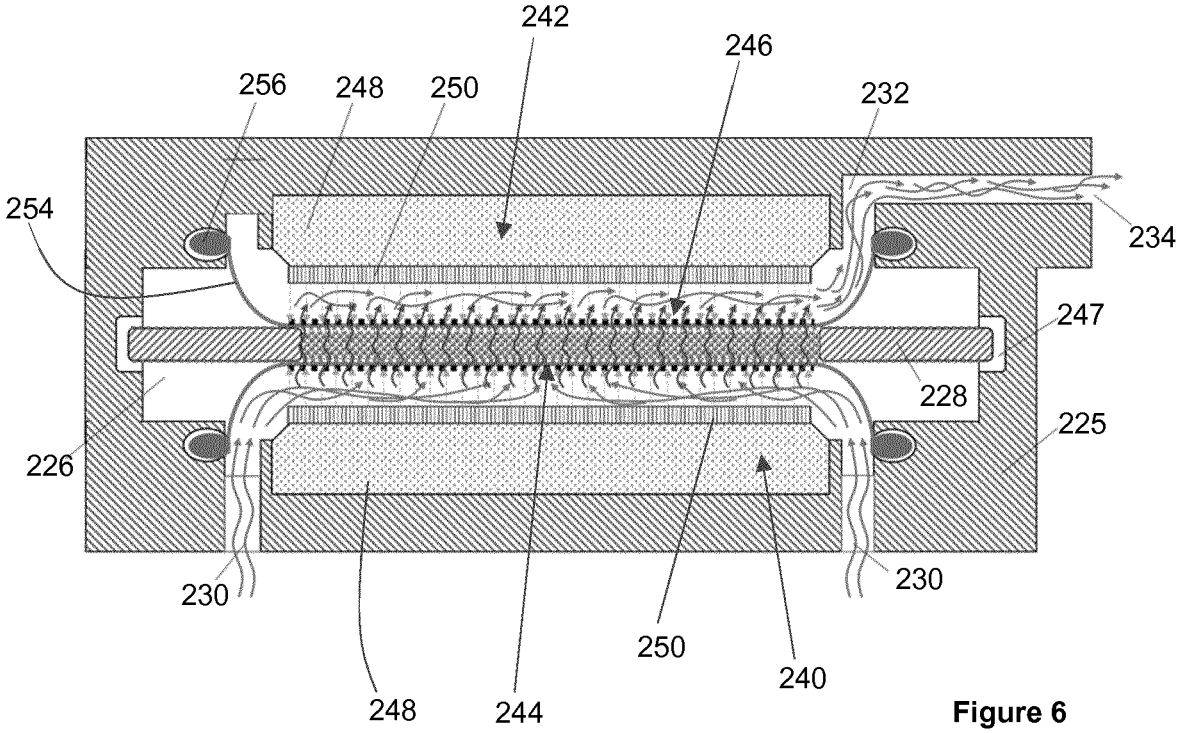
FIG. 6 shows an enlarged cross-sectional view of the device cavity of the aerosol-generating section of FIG. 5.

FIG. 6 shows an enlarged cross-section view of the device cavity 226. Positioned within the device cavity 226 is a first light source 240, a second light source 242, a first heating element 244 and a second heating element 246. When an aerosol-generating article 228 is received within a slot 247 within the device cavity 226, the aerosol-generating article 228 is positioned between the first and second heating elements 244, 246. The first and second light sources 240, 242 each comprise a light emitting diode 248 and a diffuser 250 overlying a surface of the light emitting diode 248.

Figure 7:
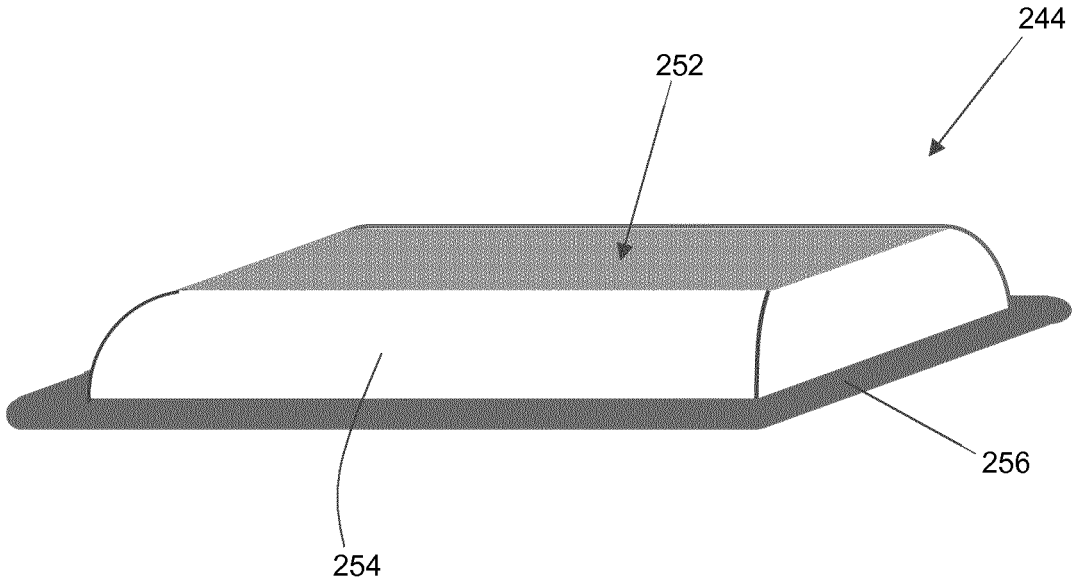
FIG. 7 shows a perspective view of the first heating element of the aerosol-generating section of FIG. 6.

FIG. 7 shows a perspective view of the first heating element 244. Although only the first heating element 244 is described in detail, it will be appreciated that the second heating element 246 is identical to the first heating element 244 in the embodiment shown in FIG. 6.

The first heating element 244 comprises a planar heating portion 252 and a support portion 254 in the form of a support skirt extending about a periphery of the planar heating portion 252. The support portion 254 comprises an attachment portion 256 that is received within the housing 225 of the aerosol-generating device 210 to mount the first heating element 244 within the device cavity 225.

Figure 8:
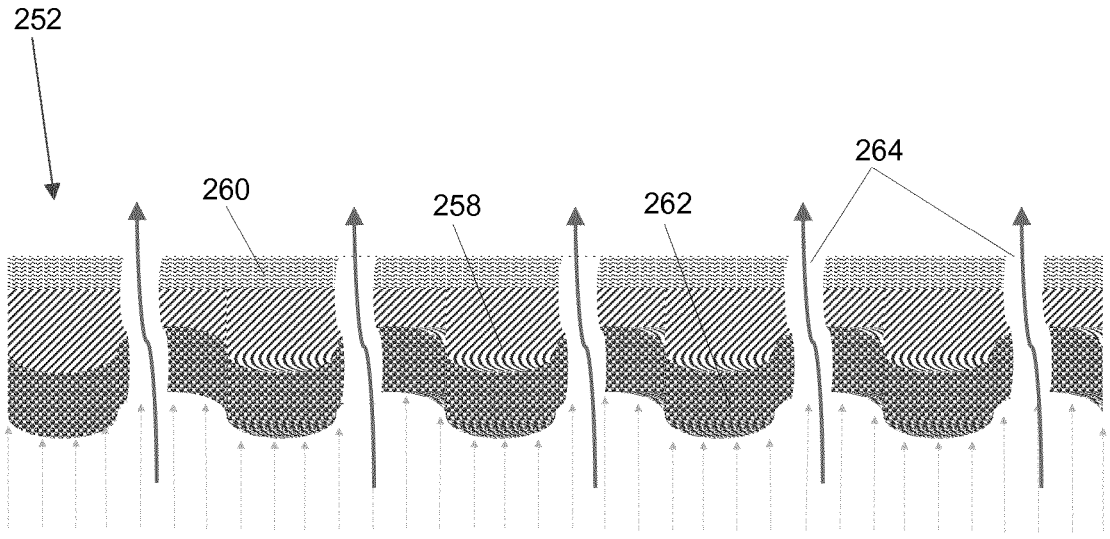
FIG. 8 shows a cross-sectional view of part of the planar heating portion of the heating element of FIG. 7.

FIG. 8 shows a cross-sectional view through part of the planar heating portion 252. The planar heating portion 252 comprises a substrate layer 258, a thermally conductive layer 260 positioned on a first surface of the substrate layer 258 and a coating layer 262 positioned on a second surface of the substrate layer 258. The coating layer 262 comprises a plurality of metallic nanoparticles. The first heating element 244 is arranged so that the coating layer 262 faces the first light source 240. During use, the metallic nanoparticles of the coating layer 262 receive light from the first light source 240 and generate heat by surface plasmon resonance. The thermally conductive layer 260 facilitates the transfer of heat generated by the coating layer 262 to the aerosol-generating article 228 received within the device cavity 226. It will be appreciated that the structure and function of the second heating element 246 and the second light source 242 are the same as the described structure and function of the first heating element 244 and the first light source 240.

The planar heating portion 252 also comprises a plurality of pores 264 that allow air to flow through the planar heating portion 252. Therefore as shown in FIGS. 5 and 6, during use, airflow enters the aerosol-generating device 210 through the airflow inlets 230, flows through the planar heating portion 252 of the first heating element 244, through the aerosol-generating article 228, through the planar heating portion of the second heating element 246, and out of the device cavity 226 through the airflow outlet 232. Aerosol generated by heating the aerosol-generating article 228 with the first and second heating elements 244, 246 is entrained in the airflow as it flows through the aerosol-generating article 228. In the embodiment shown in FIG. 6 the support portions 254 of the first and second heating elements 244, 246 are non-porous to direct airflow through the planar heating portions 252.

Figure 9:
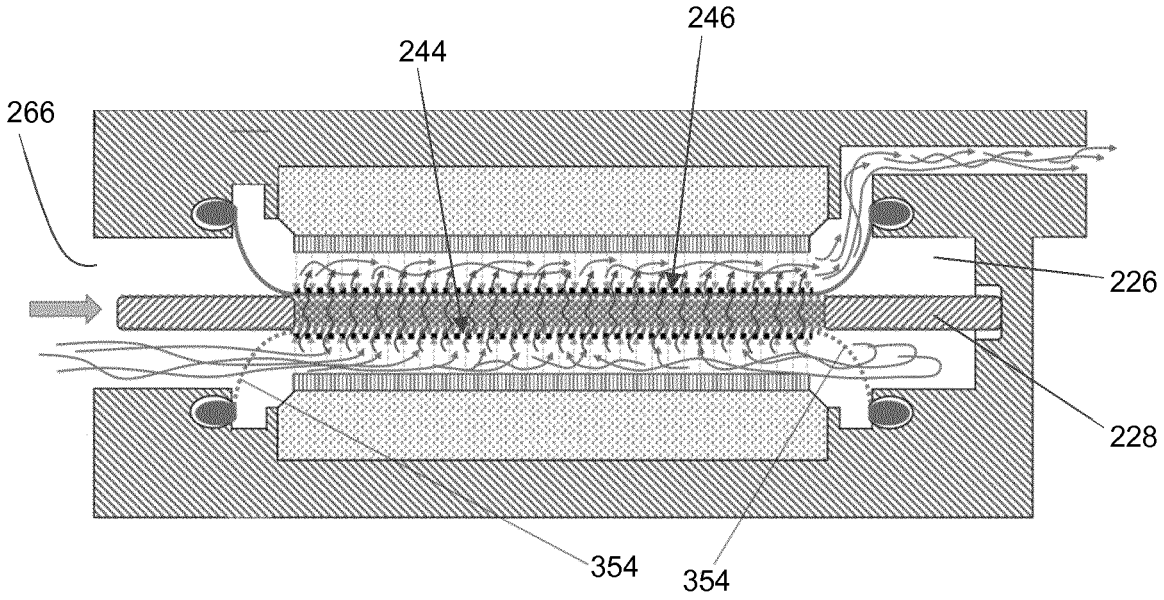
FIG. 9 shows a cross-sectional view showing an alternative configuration of the aerosol-generating section of the aerosol-generating device of FIGS. 3 and 4.

FIG. 9 shows an alternative arrangement of the aerosol-generating section 212 of the aerosol-generating device 210. The alternative arrangement shown in FIG. 9 is similar to the arrangement shown in FIG. 6 and like reference numerals are used to designate like parts.

The alternative arrangement shown in FIG. 9 differs in the lack of dedicated airflow inlets to the device cavity 226. Instead, an open end 266 of the device cavity 226 through which an aerosol-generating article 228 may be inserted into the device cavity 226 functions as an airflow inlet. As a result of the different positioning of the airflow inlet, the first heating element 244 comprises a support portion 354 that is porous. The porous support portion 354 allows airflow entering the device cavity 226 to flow into the space between the first light source 240 and the first heating element 244 so that the airflow may flow through the planar heating portions 252 of the first and second heating elements 244, 246 and the aerosol-generating article 228 in the same manner as described with reference to FIG. 6.

Figure 10:
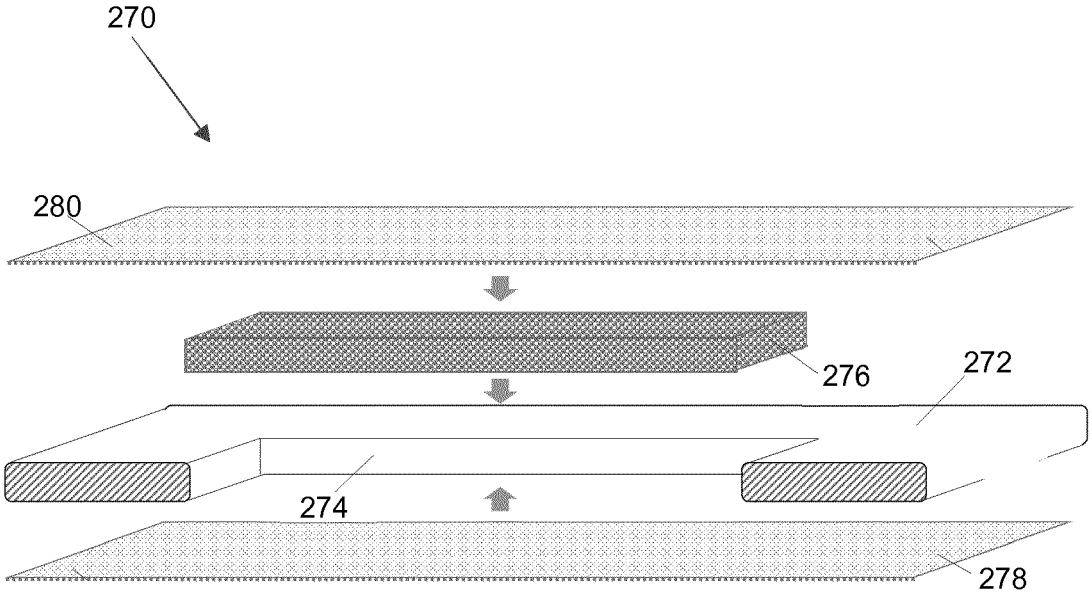
FIG. 10 shows an exploded perspective view of an aerosol-generating article for use with the aerosol-generating device of FIGS. 3 and 4.
Figure 11:
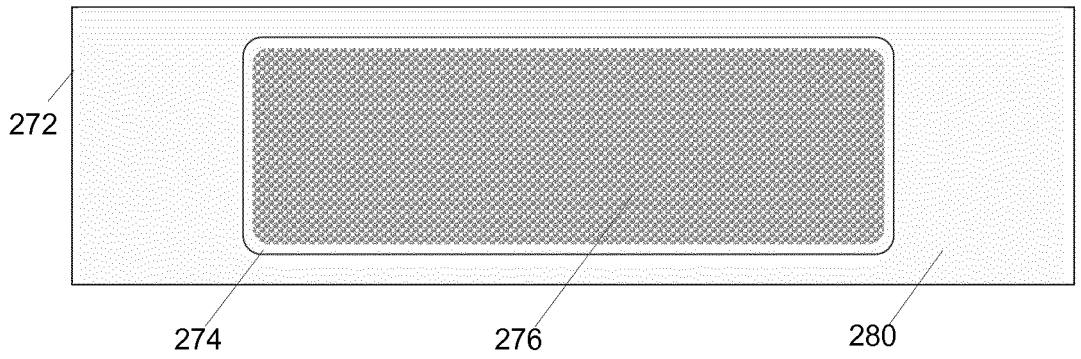
FIG. 11 shows a plan view of the aerosol-generating article of FIG. 10.

FIGS. 10 and 11 show an aerosol-generating article 270 for use with the aerosol-generating device 210. The aerosol-generating article 270 comprises a base layer 272 defining a substrate cavity 274 extending through the base layer 272. An aerosol-forming substrate 276 comprising tobacco is positioned within the substrate cavity 274. A first porous cover layer 278 overlies a first side of the base layer 272 and a second porous cover layer 280 overlies a second side of the base layer 272. The first and second porous cover layers 278, 280 are secured to the base layer 272 so that the aerosol-forming substrate 276 is positioned between the first and second porous cover layers 278, 280 and retained within the substrate cavity 274. During use of the aerosol-generating article 270 with the aerosol-generating device 210, the first and second heating elements 244, 246 heat the aerosol-forming substrate 276 to generate an aerosol. Airflow from the planar heating portion 252 of the first heating element 244 to the planar heating portion of the second heating element 246 flows through the first and second porous cover layers 278, 280 and through the aerosol-forming substrate 276 to entrain the generated aerosol within the airflow.

Figure 12:
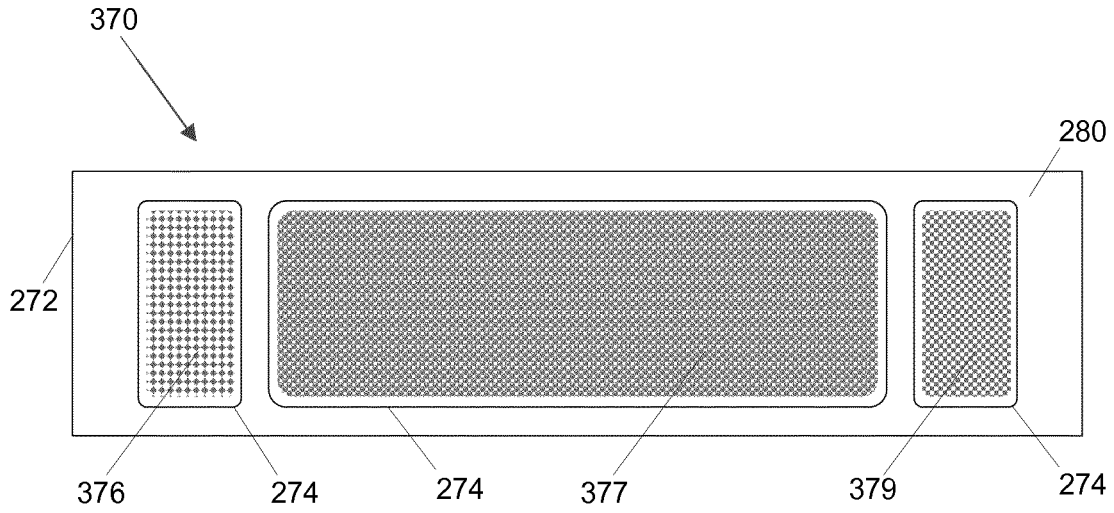
FIG. 12 shows a plan view of an alternative aerosol-generating article.

FIG. 12 shows an alternative aerosol-generating article 370 for use with the aerosol-generating device 210. The alternative aerosol-generating article 370 is similar to the aerosol-generating article 270 and like reference numerals designate like parts.

The aerosol-generating article 370 comprises a base layer 272 defining a plurality of substrate cavities 274. A first aerosol-forming substrate 376 comprises a flavourant is positioned within a first substrate cavity 274. A second aerosol-forming substrate 377 comprising a nicotine-containing liquid provided on a carrier material is positioned within a second substrate cavity 274. A third aerosol-forming substrate 379 comprising an aerosol former is positioned within a third substrate cavity 274. During use, aerosol generated by the first, second and third aerosol-forming substrates 376, 377, 379 is entrained within airflow flowing through the aerosol-generating article 370. The different aerosols are mixed together within the airflow outlet 232, the airflow passage 234 and the mixing chambers 236 for delivery to a user as a combined aerosol.

Advantageously, generating heat by surface plasmon resonance may provide more localised heating when compared to other methods of generating heat, such as resistive heating. Therefore, advantageously, the aerosol-generating device 210 may be adapted to allow localised and selective heating of the first, second and third aerosol-forming substrates 376, 377, 379. For example, the aerosol-generating device may be adapted so that at least one of the first light source 240 and the second light source 242 comprises an array of LEDs. One or more first LEDs of the array of LEDs may correspond to a first area of the planar heating portion 252 corresponding to the first aerosol-forming substrate 376. One or more second LEDs of the array of LEDs may correspond to a second area of the planar heating portion 252 corresponding to the second aerosol-forming substrate 377. One or more third LEDs of the array of LEDs may correspond to a third area of the planar heating portion 252 corresponding to the third aerosol-forming substrate 379. The controller 229 may be configured to selectively supply power to first LEDs, the second LEDs, the third LEDs, and combinations thereof, in response to a user input received from a user input device, such as the push-button 222. Using the push-button 222, a user may vary the ratio of aerosolised first, second and third aerosol-forming substrates 376, 377, 379. In response to the user input, the controller 229 may vary a total light output for each of the first, second and third LEDs to provide the required heating of the first, second and third aerosol-forming substrates 376, 377, 379 that generates the desired aerosol ratio. Advantageously, since heating by surface plasmon resonance is fast when compared to other heating mechanisms, such as resistive heating, the aerosol-generating device 210 may modify the generated aerosol in real-time in response to user inputs.

For example, a user may use the push-button 222 to request an increased amount of flavourant in the delivered aerosol. In response, the controller 229 may increase a supply of power to the first LEDs to increase heating of the first area of the planar heating portion 252, which increases heating of the first aerosol-forming substrate 376.

In another example, a user may use the push-button 222 to request a decreased amount of flavourant and an increased amount of nicotine. In response, the controller 229 may decrease a supply of power to the first LEDs to decrease heating of the first area of the planar heating portion 252 and decrease heating of the first aerosol-forming substrate 376, and increase a supply of power to the second LEDs to increase heating of the second area of the planar heating portion 252 and increase heating of the second aerosol-forming substrate 377.

To simplify user interaction with the aerosol-generating device 210, the push-button 222 may be supplemented with or replaced by a different type of user input device, such as a touch-screen.

Figure 13:
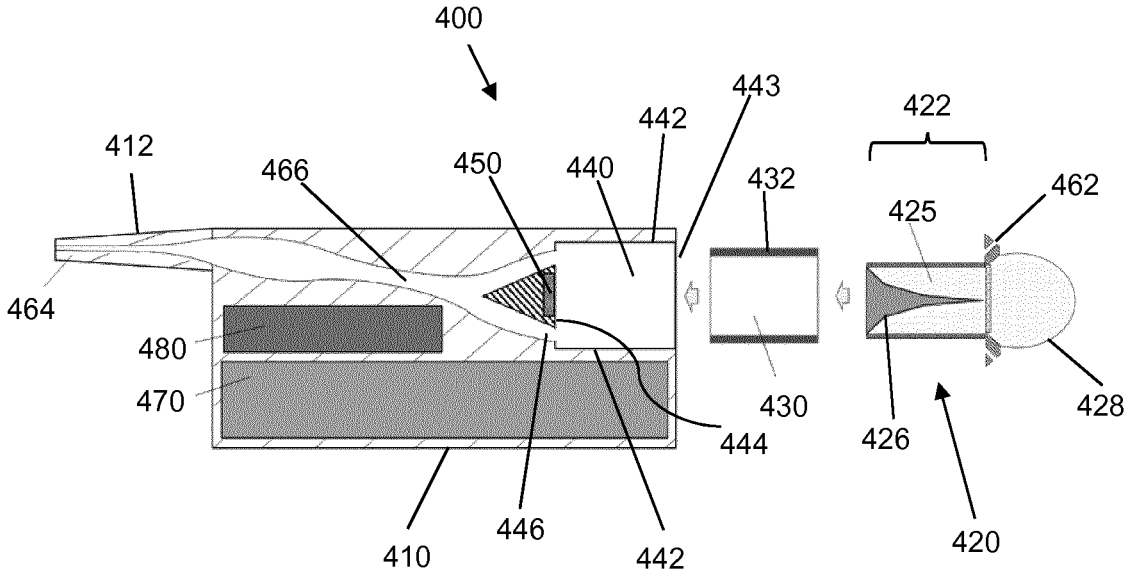
FIG. 13 shows a cross-sectional view of an aerosol-generating article, together with an aerosol-generating device according to a fourth embodiment of the present invention, as seen in an unassembled condition.

As can be seen from FIG. 13, the aerosol-generating device 400 of a fourth embodiment of the invention comprises a main body 410 and a heating element 420. The main body 410 has a cavity 440 disposed at one end. The cavity 440 is arranged to receive the heating element 420 and an aerosol-generating article 430, which comprises a substantially cylindrical aerosol-forming substrate 432.

The cavity has a cylindrical side wall 442, which extends from an opening 443 on the outer surface of the main body 410 of the device 400 to a cavity base wall 444. An opening is also provided around the periphery of the cavity base wall 444. This may permit aerosol to flow to an air outlet 464 of the device along a passageway 466. The outlet 464 is provided at a mouthpiece 412 of the device.

The cavity base wall 444 further comprises a device light source 450, in the form of a plurality of light emitting diodes (LEDs). The device light source 450 is arranged to receive electrical power from a power supply 470 within the main body 410, in the form of a Lithium-ion battery. A controller 480 is also provided within the main body 410 of the device to control the supply of electrical power to the light source 450.

Figure 15:
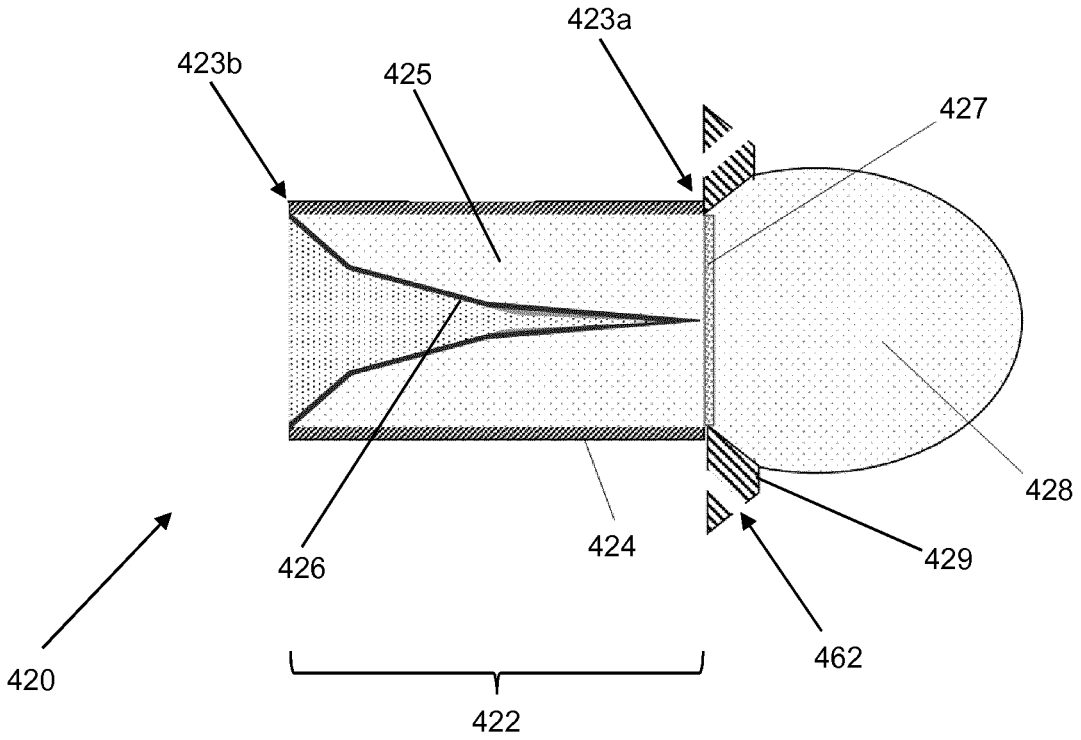
FIG. 15 shows a cross-sectional view of the heating element of FIGS. 13 and 14.

As best seen from FIG. 15, the heating element 420 comprises an elongate body 422 having a first end 423*a* and a second end 423*b*, with a substantially cylindrical wall 424 extending from the first end 423*a* to the second end 423*b*. The wall 424 of the elongate body 422 defines a light chamber 425 within the heating element 420. The light chamber 425 may receive ambient light at a first end of the light chamber 425, via a first optical element 427 at the first end of the light chamber, and an optical component 428 attached to and extending from the first end 423*a* of the elongate body 422.

The optical component 428 is in the form of a bulbous structure comprising glass. The optical component 428 functions to increase the amount of ambient light receivable through the first end 423*a* of the elongate body 422.

The first optical element 427 provides one-way light transmission, in that it allows ambient light to enter the light chamber 425 through the first end 423*a*, but prevents light from escaping the light chamber 425 through the first end, by way of reflection or adsorption. In particular, the first optical element 427 may be a glass substrate having a metallic coating, which reflects any light falling incident on the surface of the element 427 facing the light chamber 425.

The second end 423*b* of the heating element is open or provided with a transparent transverse wall, so that light may enter the light chamber 425 through the second end 423*b*. As will be explained in more detail below with reference to FIG. 14, such light may originate from the device light source 450 in the main body 410 of the device, when the heating element 420 is inserted into the cavity 440.

The inner surface of the wall 424 of the elongate body 422 of the heating element 420 comprises one or more portions having a coating comprising a plurality of metallic nanoparticles. When light is incident on the plurality of metallic nanoparticles heat is generated by surface plasmon resonance of the metallic nanoparticles. Such heat may be used to heat the aerosol-forming substrate 432 of the aerosol-generating article 430, when the heating element 420 is adjacent to the article 430.

The light chamber 425 of the heating element 420 contains a second optical element 426, which in the first embodiment, is in the form of a conical shaped structure, having its widest end at the second end 423*b* of the elongate body 422. The second optical element is arranged to redirect light towards the inner surface of the wall 424, and more specifically, towards the plurality of metallic nanoparticles on the wall 424. The second optical element 426 divides the light chamber 425 into two sections; a first section and a second section. A reflective coating is provided on the second optical element 426, such that ambient light, which is received through the first end 423*a* and which is incident on the optical element 426 is reflected towards the inner surface of the wall 424. This helps to ensure that light received through the first end 423*a* of the light chamber is not lost through the second end of the light chamber. In addition, light received through the second end 423*b* of the light chamber 425 may pass through the second optical element 426 into the first section of the optical chamber 425, and is preferably diverted towards the inner surface of the wall 424 by virtue of the conical shape of the second optical element 426. Once the light is in the first section of the light chamber 425, it is substantially prevented from escaping the first section of the light chamber 425 by virtue of the reflective coating on the first optical element 427 and the reflective coating on the second optical element 426. This helps to increase the amount of light that is received by plurality of metallic nanoparticles on the inner surface of the wall 424.

Figure 14:
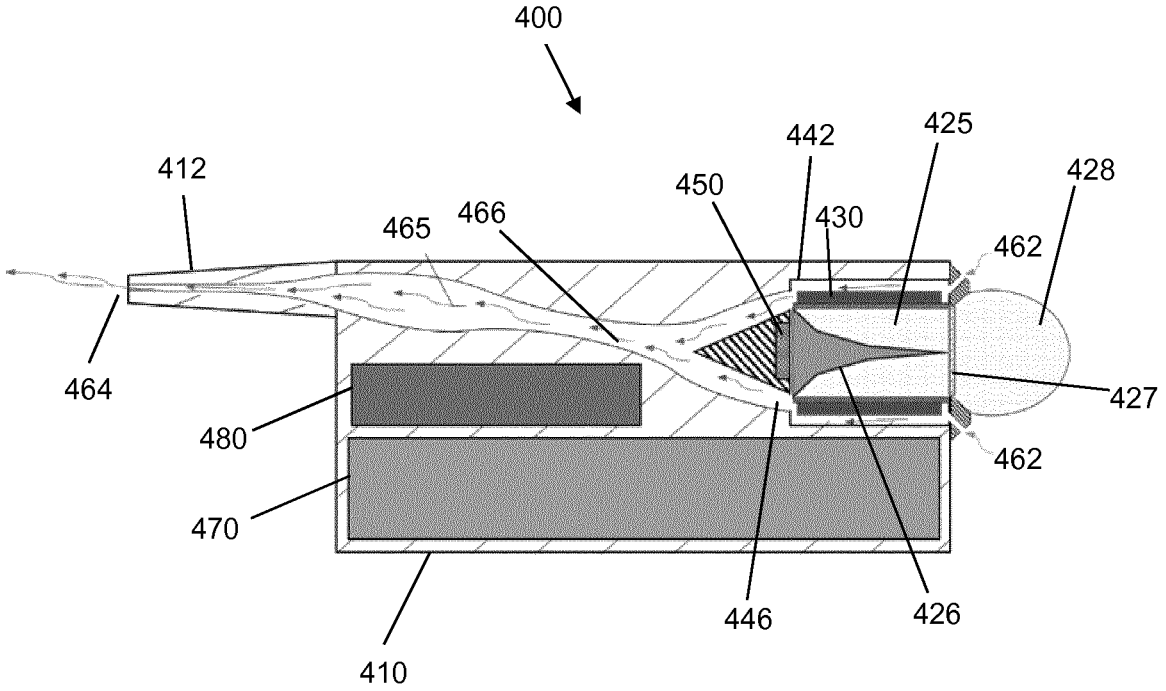
FIG. 14 shows a cross-sectional view of the aerosol-generating article and the aerosol-generating device of FIG. 13, as seen in an assembled condition.

The heating element 420 also comprises a flange 429 extending laterally from the first end of the elongate body 422. As shown in FIG. 14, the flange is arranged to cover a peripheral region of the opening 443 of the cavity 440, when the heating element 420 is disposed within the cavity 440. The flange includes one or more openings, which act as air inlets 462. These allow air to flow into the cavity 440 when the device 400 is in use.

As best seen from FIG. 14, when the device 400 is to be used, the heating element 420 is inserted into the cavity 440 of the main body 410. Disposed around the outside of the heating element 420 is the aerosol-generating article 430 comprising the aerosol-forming substrate 432. The second end 423*b* of the elongate body 422 abuts the base 444 of the cavity 440, and the flange 429 rests on top of an edge of the housing of the main body 410, which edge defines the opening 443 of the cavity 444. The device light source 450 is arranged to emit light into the light chamber 425 via the second end 423*b* of the elongate body 422 of the heating element 420. When in the assembled condition shown in FIG. 14, an airflow path extends from the air inlet 462 in the flange 429 of the heating element 420 to the air outlet 464 in the mouthpiece 412 of the device main body 410. The airflow path extends: from the air inlet 462; along an annular space defined between the outer surface of the wall 424 of the elongate body 420 and the inner surface of the cavity side wall 442; through an opening 446 in the base wall 444 of the cavity 440; and along passageway 466, which comprises a venturi portion 465, until it reaches the air outlet 464.

The aerosol-forming substrate 432 of the aerosol-generating article 430 may be heated by the wall 424 of the heating element 420, so that an aerosol is formed as air passes through the space in which the aerosol-generating article 430 is disposed. Heat may be created at the wall 424 of the heating element 420 by way of surface plasmon resonance, which occurs when light is incident on the plurality of metallic nanoparticles disposed on the inner surface of the wall 424. The heat may be generated solely by way of ambient light being received through the first end of the heating element 420. Alternatively, heat may be generated by way of a combination of ambient light being received through the first end of the heating element 420, and light received from the device light source 450 through the second end of the heating element 420. Light from the light source 450 may be initiated by the controller 480 issuing a command for the electrical power supply 470 to supply electrical power to the light source 450.

The invention claimed is:

1. An aerosol-generating device, comprising:

a heating element comprising a plurality of metallic nanoparticles configured to receive light and to generate heat by surface plasmon resonance, wherein the heating element is configured to heat an aerosol-forming substrate.

2. The aerosol-generating device according to claim 1, further comprising a light source, wherein the heating element is further configured to receive the light from the light source and to generate heat by the surface plasmon resonance.

3. The aerosol-generating device according to claim 2, wherein the light source is configured to emit light comprising at least one wavelength between 380 nanometers and 700 nanometers.

4. The aerosol-generating device according to claim 2, wherein the light source is configured to have a peak emission wavelength of between 495 nanometers and 580 nanometers.

5. The aerosol-generating device according to claim 2, wherein the light source comprises at least one of a light emitting diode and a laser.

6. The aerosol-generating device according to claim 2, wherein the light source comprises a plurality of light sources, and wherein at least one of the light sources is configured to irradiate only a portion of the plurality of metallic nanoparticles.

7. The aerosol-generating device according to claim 2, further comprising:

an electrical power supply; and a controller configured to supply electrical power from the electrical power supply to the light source.

8. The aerosol-generating device according to claim 1, wherein the plurality of metallic nanoparticles comprise at least one of gold, silver, platinum, and copper.

9. The aerosol-generating device according to claim 1, wherein the plurality of metallic nanoparticles comprise a number average maximum diameter of less than 150 nanometers.

10. The aerosol-generating device according to claim 1, wherein the heating element further comprises a substrate layer and a coating layer on at least a portion of the substrate layer, and wherein the coating layer comprises the plurality of metallic nanoparticles.

11. The aerosol-generating device according to claim 10, wherein the coating layer is disposed on a first surface of the substrate layer, and wherein the first surface of the substrate layer comprises at least one of a plurality of protrusions and a plurality of depressions.

12. The aerosol-generating device according to claim 10, wherein the coating layer further comprises a plurality of discrete areas of metallic nanoparticles, and wherein the plurality of discrete areas are spaced apart from each other on the substrate layer.

13. The aerosol-generating device according to claim 1, wherein the heating element is further configured to receive a supply of electrical power to resistively heat the heating element.

14. The aerosol-generating device according to claim 1, wherein at least a portion of the heating element is porous.

15. The aerosol-generating device according to claim 1, further comprising a cavity configured to receive at least part of the aerosol-forming substrate.

16. The aerosol-generating device according to claim 15, wherein the heating element at least partially defines the cavity so that, when the aerosol-forming substrate is received within the cavity, at least part of the aerosol-forming substrate is received adjacent the heating element.

17. The aerosol-generating device according to claim 15, wherein at least part of the heating element extends into the cavity.

18. The aerosol-generating device according to claim 1, further comprising:

a storage portion, wherein the aerosol-forming substrate is disposed within the storage portion.

19. An aerosol-generating system, comprising:

the aerosol-generating device according to claim 1; and an aerosol-generating article comprising the aerosol-forming substrate, wherein the aerosol-generating device is configured to receive at least a portion of the aerosol-generating article.

* * * * *